US010837132B2

(12) United States Patent
Hozumi

(10) Patent No.: US 10,837,132 B2
(45) Date of Patent: Nov. 17, 2020

(54) MULTIPLE GAUZE FABRIC

(71) Applicant: Uchino Co., Ltd., Tokyo (JP)

(72) Inventor: Shuichi Hozumi, Tokyo (JP)

(73) Assignee: UCHINO CO., LTD., Tokyo (JP)

( * ) Notice: Subject to any disclaimer, the term of this patent is extended or adjusted under 35 U.S.C. 154(b) by 105 days.

(21) Appl. No.: 16/331,122

(22) PCT Filed: Sep. 6, 2016

(86) PCT No.: PCT/JP2016/076212
§ 371 (c)(1),
(2) Date: Mar. 6, 2019

(87) PCT Pub. No.: WO2018/047243
PCT Pub. Date: Mar. 15, 2018

(65) Prior Publication Data

US 2019/0226126 A1 Jul. 25, 2019

(51) Int. Cl.
*D03D 19/00* (2006.01)
*D03D 11/00* (2006.01)
(Continued)

(52) U.S. Cl.
CPC ..... *D03D 11/00* (2013.01); *D03D 15/00* (2013.01); *D03D 19/00* (2013.01); *D03D 23/00* (2013.01); *D03D 2700/0111* (2013.01)

(58) Field of Classification Search
CPC ..... B32B 5/024; B32B 5/26; B32B 2250/20; B32B 2305/188; B32B 37/144;
(Continued)

(56) References Cited

U.S. PATENT DOCUMENTS 7,699,949 B2 * 4/2010 Newton ..... D03D 19/00 156/60
10,077,510 B2 * 9/2018 Hozumi ..... D03D 11/00
(Continued)

FOREIGN PATENT DOCUMENTS

CN 104321476 A 1/2015
CN 104494169 A 4/2015
(Continued)

OTHER PUBLICATIONS

WIPO, Japan International Search Authority, International Search Report and Written Opinion dated Nov. 22, 2016 in International Patent Application No. PCT/JP2016/076212, 13 pages.
(Continued)

*Primary Examiner* — Robert H Muromoto, Jr.
(74) *Attorney, Agent, or Firm* — Masuvalley & Partners

(57) ABSTRACT

Provided is a multiple gauze fabric having excellent friction strength while maintaining skin feel like twistless yarn fabric. The multiple gauze fabric is constituted from a first gauze structure as a front surface, a second gauze structure as a back surface, and a third gauze structure as an intermediate layer. The first gauze structure is formed using a first twisted yarn as a warp, and using a second twisted yarn as a weft. The second gauze structure is formed using a third twisted yarn as a weft, and a fourth twisted yarn as a warp. The third gauze structure is formed using a fifth twisted yarn as a warp, and a sixth twisted yarn as a weft. The twist coefficient of second and fourth twisted yarn is 3.0 or less. The twist coefficient of first, third, fifth and sixth twisted yarn is 3.3 or more.

18 Claims, 7 Drawing Sheets

(51) Int. Cl.

| | |
|---|---|
| ***D03D 15/00*** | (2006.01) |
| *D03D 1/00* | (2006.01) |
| *D03D 23/00* | (2006.01) |

(58) Field of Classification Search

CPC ..... D03D 19/00; D03D 11/00; D03D 2700/0174; D03D 13/004; D03D 15/00; D03D 15/0077; D03D 2700/0111; D03D 9/00; A61F 13/00021

See application file for complete search history.

(56) References Cited

U.S. PATENT DOCUMENTS

| | | | | |
|---|---|---|---|---|
| 10,597,804 | B2 * | 3/2020 | Hozumi | B32B 3/28 |
| 2004/0266291 | A1 * | 12/2004 | Pintz | D03D 19/00 442/2 |
| 2005/0221706 | A1 * | 10/2005 | Bader | A41D 31/08 442/181 |
| 2007/0209731 | A1 * | 9/2007 | Chang | A47C 31/007 139/420 A |
| 2010/0108244 | A1 * | 5/2010 | Newton | D03D 15/0011 156/229 |
| 2016/0101333 | A1 * | 4/2016 | McCampbell | A63B 59/20 473/513 |
| 2016/0201233 | A1 * | 7/2016 | Hozumi | D03D 11/00 442/246 |
| 2019/0062961 | A1 * | 2/2019 | Hozumi | D03D 15/04 |
| 2019/0191801 | A1 * | 6/2019 | Hozumi | D03D 15/04 |

FOREIGN PATENT DOCUMENTS

| | | | |
|---|---|---|---|
| CN | 107002320 | A | 8/2017 |
| CN | 107923084 | A | 4/2018 |
| JP | 2005-330613 | A | 12/2005 |
| JP | 2010077542 | A | 4/2010 |
| JP | 5435607 | B1 | 3/2014 |
| JP | 5534383 | B1 | 6/2014 |
| JP | 5971743 | B1 | 8/2016 |
| TW | 201531606 | A | 8/2015 |
| WO | WO2015/097784 | A1 | 7/2015 |
| WO | WO2016/092652 | A1 | 6/2016 |

OTHER PUBLICATIONS

Taiwan Intellectual Property Office; Office Action dated Jan. 8, 2018 issued in corresponding Taiwanese Patent Application No. 106125481, total 3 pages.

China Intellectual Property Office; Office Action dated Jul. 25, 2019 issued in corresponding Chinese Patent Application No. 201680087925.1, total 5 pages.

* cited by examiner

THREE LAYERS
FRONT AND BACK
LAYERS IN
ORTHOGONAL
DIRECTION

FIRST EMBODIMENT
THREE LAYERS
FRONT AND BACK LAYERS IN
ORTHOGONAL DIRECTION

THIRD EMBODIMENT
THREE LAYERS
FRONT AND BACK LAYERS IN
THE SAME DIRECTION

DOUBLE WOVEN GAUZE

MULTIPLE GAUZE FABRIC

RELATED APPLICATIONS

This application is the U.S. National Phase of and claims priority to International Patent Application No. PCT/JP2016/076212, International Filing Date Sep. 6, 2016, entitled Multiple Gauze Fabric, which is incorporated herein by reference in its entirety.

TECHNICAL FIELD

The present invention relates to a multiple (multi-ply) gauze fabric.

BACKGROUND ART

The gauze fabric is a coarse-meshed flat woven fabric constituted of a relatively thin thread.

The gauze fabric is made of an ordinary cotton twist yarn that is not hollow. Examples of a cotton gauze fabric include a single woven fabric, a double woven fabric, and a triple woven fabric. The single woven gauze fabric is employed in, for example, medical use and dishcloth. The double woven gauze fabric is employed in, for example, clothing and handkerchieves. They are made of a cotton yarn (mainly, a 40-English count single yarn (Ne)). The triple woven gauze fabric is employed in, for example, towels and bed and bedding. The triple woven gauze fabric employs a cotton yarn. A typical single weave construction is dense with the total 50-120 warp yarns and weft yarns per inch. A fabric of which density is less than 50 yarns does not constitute gauze. A fabric of which density is beyond 120 yarns (high density) is not generally called gauze.

FIG. 14 is a sectional view illustrating a typical double woven gauze fabric. The double woven gauze fabric includes a front side-gauze structure and a back side-gauze structure. The gauze structure is constituted of warps (lengthwise yarns on a loom) and wefts (crosswise yarns on a loom). A gauze structure of a plain woven pattern is formed by drawing wefts across warps while supplying the warps. The front side-gauze structure and the back side-gauze structure are joined together appropriately, concurrent with formation of the front side-gauze structure and the back side-gauze structure. As shown in FIG. 14, warps may form connection parts or wefts may form connection parts.

A gauze is a coarse-meshed fabric (with large gaps between yarns). Because the gauze is a coarse-meshed flat woven fabric, it has outstanding breathability and outstanding lightness.

However, the gauze fabric is poor in a heat-retaining property. The gauze fabric is thin even when it is made into a multiple gauze, and therefore, a heat-retaining property cannot be expected. If the number of gauzes to be superimposed is increased for obtaining a necessary heat-retaining property, the lightness will be lost markedly.

Because the gauze is a coarse-meshed fabric, it is poor in bounce and softness.

Because the gauze is a coarse-meshed fabric, the skin is seen through in consequence if it is used in, for example, clothes. If the gauze employs a thick yarn or is woven densely, a transparency preventing property improves but the breathability and the lightness which are characteristics of gauze will be lost largely.

For the reasons as set forth above, it was considered that the conventional gauze fabrics having various performances were not sufficiently effective to be applied to cloth for clothes and bedding and thus needed more to do for improvement.

Meanwhile, a pile towel is sometimes made of a non-twisted yarn-pile and a soft twist yarn-pile.

A typically used twisted yarn is formed by twisting raw cotton fibers. To the contrary, a non-twisted yarn is formed by untwisting a twisted yarn to return it to a non-twisted state.

The non-twisted yarn fluffily puffs and contains much air between fibers. Therefore, the non-twisted yarn-pile realizes the heat-retaining property and a feel of soft touch.

A soft twist yarn is made by untwisting a twisted yarn just like the non-twisted yarn except for leaving some twisting. The soft twist yarn also has a property close to the non-twisted yarn.

The inventor made a study of applying the non-twisted yarn or the soft twist yarn to the gauze fabric. The gauze structure constituted of the non-twisted yarn or the soft twist yarn has more bulkiness in comparison with the gauze structure constituted of the twisted yarn while keeping the breathability and the lightness. As a result, the heat-retaining property, the feel of soft touch, and the transparency preventing property improve.

Generally, the non-twisted yarn and the soft twist yarn are poor in strength compared with the twisted yarn. That is, the gauze structure constituted of only a non-twisted yarn is poor in strength. Similarly, the gauze structure constituted of only a soft twist yarn is also poor in strength. Even when they are formed into a multiple gauze, a remarkable improvement in strength is not expected.

To solve the above problem, the inventor made a study of applying the non-twisted yarn and the soft twist yarn to a multiple gauze fabric that is formed by joining the gauze structure constituted of twisted yarn and the gauze structure constituted of non-twisted yarn (or soft twist yarn).

The gauze structure constituted of a twisted yarn serves to maintain the strength while the gauze structure constituted of a non-twisted yarn (or a soft twist yarn) produces the heat-retaining property, the feel of soft touch, and the transparency preventing property. That is, a combination of both structures realizes the gauze fabric having both advantages.

The inventor has proposed the multiple gauze fabrics as disclosed in, for example, Patent Literature 1 and Patent Literature 2 as related inventions.

CITATION LIST

Patent Literature

[PATENT LITERATURE 1] JP 5435607 B1
[PATENT LITERATURE 2] JP 5534383 B1

SUMMARY OF INVENTION

Technical Problem

The multiple gauze fabrics (related inventions) disclosed in Patent Literature 1 and Patent Literature 2 are excellent specially in a feel of soft touch because a non-twisted yarn (or a soft twist yarn) exposes on a front surface (back surface). Also, a difference in shrinkage between the non-twisted yarn (or the soft twist yarn) and the twisted yarn contributes to generation of wrinkles. The feel of soft touch improves because of bulkiness caused by the wrinkles.

The multiple gauze fabrics disclosed in Patent Literatures 1 and 2 are inferior to the typical multiple gauze in frictional strength because the non-twisted yarn (or the soft twist yarn) exposes on the front surface (back surface). The gauze structure constituted of a twisted yarn contributes to maintaining of cloth strength but does not contribute to improvement of frictional strength because it is used as a middle layer.

Generally, production of the gauze structure constituted of a non-twisted yarn (or a soft twist yarn) requires more production steps in comparison with the gauze structure constituted of a twisted yarn. This increases a production cost of the multiple gauze fabrics disclosed in the related inventions in comparison with the typical multiple gauze.

To solve the above problem, a purpose of the present invention is to provide a gauze fabric excellent in frictional strength while maintaining a good touch feeling (softness) equivalent to the multiple gauze fabrics disclosed in the related inventions.

Solution to Problem

According to an aspect of the present invention for solving the above described problem, a multiple gauze fabric constituted of a plurality of gauze structures including a first gauze structure corresponding to a front surface, a second gauze structure corresponding to a back surface, and a third gauze structure corresponding to a middle layer is provided. The first gauze structure and the second gauze structure are joined together directly and/or indirectly. The first gauze structure is formed by employing a first twisted yarn having a 3.3 or greater twisting coefficient as one of a warp or a weft and a second twisted yarn having a 3.0 or less twisting coefficient as the other one of the warp or the weft. The second gauze structure is formed by employing a third twisted yarn having a 3.3 or greater twisting coefficient as one of a warp or a weft and a fourth twisted yarn having a 3.0 or less twisting coefficient as the other one of the warp or the weft. The third gauze structure is formed by employing a fifth twisted yarn having a 3.3 or greater twisting coefficient as a warp and a sixth twisted yarn having a 3.3 or greater twisting coefficient as a weft.

In the embodiment of the present invention, it is preferred that, in the first gauze structure, the first twisted yarn is a 20-60 count yarn and is set to a density of 25-60 yarns (both inclusive) per inch, and the second twisted yarn is a 20-60 count yarn and is set to a density of 25-60 yarns (both inclusive) per inch. In the second gauze structure, the third twisted yarn is a 20-60 count yarn and is set to a density of 25-60 yarns (both inclusive) per inch, and the fourth twisted yarn is a 20-60 count yarn and is set to a density of 25-60 yarns (both inclusive) per inch.

In the above embodiment of the present invention, it is preferred that, in the first gauze structure, the second twisted yarn is thicker than the first twisted yarn. In the second gauze structure, the fourth twisted yarn is thicker than the third twisted yarn.

In the embodiment of the present invention, it is more preferred that, in the first gauze structure, the second twisted yarn is arranged to, after passing through one side of N (N is an integer equal to or greater than 2) number of first twisted yarns, pass through the other side of one of the N number of first twisted yarns, and a side on which the second twisted yarn exposes more is arranged as a front surface. In the second gauze structure, the fourth twisted yarn is arranged to, after passing through one side of N (N is an integer equal to or greater than 2) number of third twisted yarns, pass through the other side of one of the N number of third twisted yarns, and a side on which the fourth twisted yarn exposes more is arranged as a back surface.

According to an aspect of the present invention for solving the above described problem, a multiple gauze fabric constituted of a plurality of gauze structures including a first gauze structure corresponding to a front surface, a second gauze structure corresponding to a back surface, and a third gauze structure corresponding to a middle layer is provided. The first gauze structure and the second gauze structure are joined together directly and/or indirectly. The first gauze structure is formed by employing a first twisted yarn having a 3.3 or greater twisting coefficient as a warp (or a weft) and a second twisted yarn having a 3.0 or less twisting coefficient as a weft (or a warp). The second gauze structure is formed by employing a third twisted yarn having a 3.3 or greater twisting coefficient as a weft (or a warp) and a fourth twisted yarn having a 3.0 or less twisting coefficient as a warp (or a weft). The third gauze structure is formed by employing a fifth twisted yarn having a 3.3 or greater twisting coefficient as a warp and a sixth twisted yarn having a 3.3 or greater twisting coefficient as a weft.

According to an aspect of the present invention for solving the above described problem, a double gauze fabric constituted of a first gauze structure corresponding to a front surface and a second gauze structure corresponding to a back surface is provided. The first gauze structure and the second gauze structure are joined together directly and/or indirectly. The first gauze structure is formed by employing a first twisted yarn having a 3.3 or greater twisting coefficient as a warp (or a weft) and a second twisted yarn having a 3.0 or less twisting coefficient as a weft (or a warp). The second gauze structure is formed by employing a third twisted yarn having a 3.3 or greater twisting coefficient as a weft (or a warp) and a fourth twisted yarn having a 3.0 or less twisting coefficient as a warp (or a weft).

According to an aspect of the present invention for solving the above described problem, a multiple gauze fabric constituted of a plurality of gauze structures including a first gauze structure corresponding to a front surface, a second gauze structure corresponding to a back surface, and a third gauze structure corresponding to a middle layer is provided. The first gauze structure and the second gauze structure are joined together directly and/or indirectly. The first gauze structure is formed by employing a first twisted yarn having a 3.3 or greater twisting coefficient as a warp (or a weft) and a second twisted yarn having a 3.0 or less twisting coefficient as a weft (or a warp). The second gauze structure is formed by employing a third twisted yarn having a 3.3 or greater twisting coefficient as a warp (or a weft) and a fourth twisted yarn having a 3.0 or less twisting coefficient as a weft (or a warp). The third gauze structure is formed by employing a fifth twisted yarn having a 3.3 or greater twisting coefficient as a warp and a sixth twisted yarn having a 3.3 or greater twisting coefficient as a weft.

According to an aspect of the present invention for solving the above described problem, clothes produced by sewing the multiple gauze fabric is provided.

According to an aspect of the present invention for solving the above described problem, bedding produced by sewing the multiple gauze fabric is provided.

Advantageous Effect of Invention

The multiple gauze fabric of the present invention maintains a good touch feeling (softness) equivalent to the multiple gauze fabrics according to the related inventions.

The multiple gauze fabric of the present invention is excellent in frictional strength in comparison with the multiple gauze fabrics according to the related inventions.

The multiple gauze fabric of the present invention saves production cost in comparison with the multiple gauze fabrics according to the related inventions.

For the reasons as set forth above, the multiple gauze fabric of the present invention is suitable for cloth of clothes and bedding.

DESCRIPTION OF EMBODIMENTS

First Embodiment

~Structure~

Figure 1:
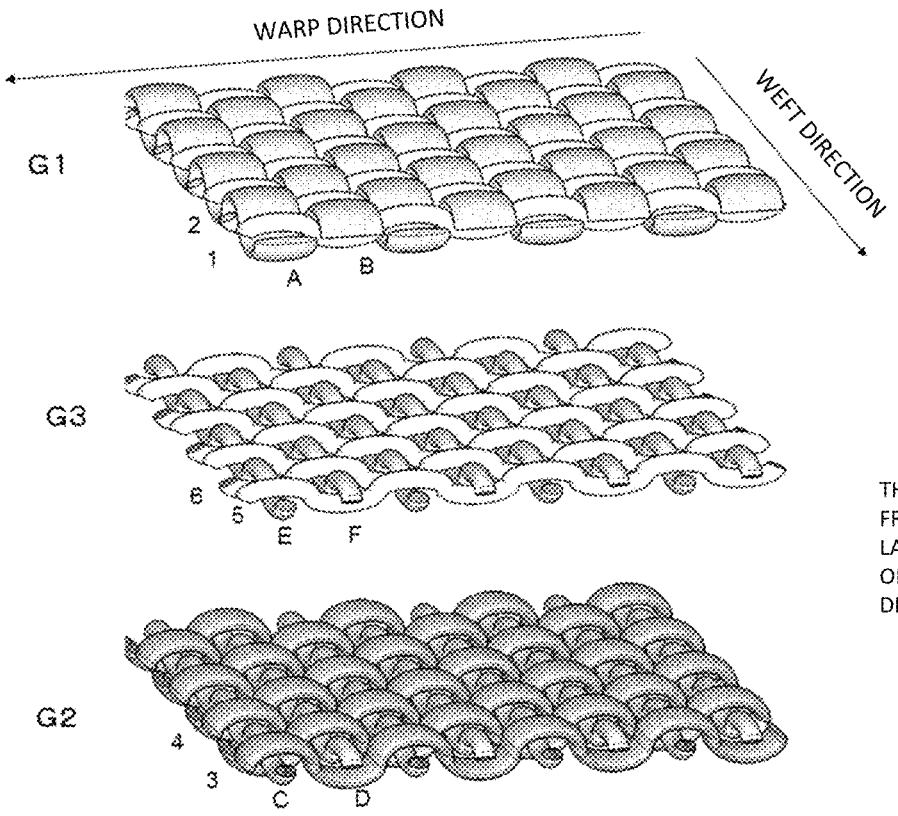
FIG. 1 shows a conceptual scheme of a multiple gauze fabric according to a first embodiment.
Figure 2:
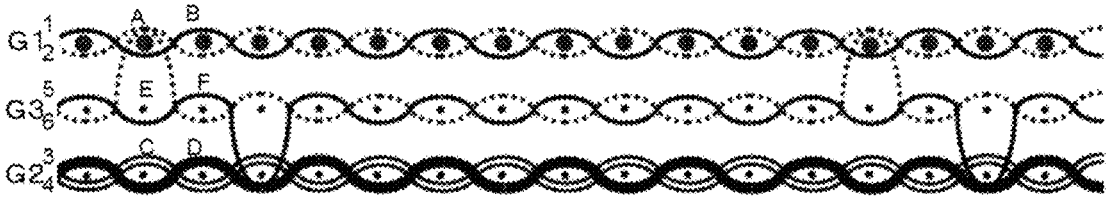
FIG. 2 is a sectional view of the multiple gauze fabric according to the first embodiment.

FIG. 1 is a conceptual scheme of a multiple gauze fabric according to a first embodiment of the present invention. Here, for the sake of simplification, a joining structure is omitted from the drawing. FIG. 2 is a sectional view of the multiple gauze fabric according to the first embodiment. The present invention is directed to an N-ply (N is an integer equal to or greater than 2) woven gauze fabric. Here, a triple woven gauze fabric will be exemplified for easy understanding of the invention.

The gauze fabric includes a top gauze layer G1, a bottom gauze layer G2, and a middle gauze layer G3.

The top gauze layer G1 and the bottom gauze layer G2 may be directly joined together after passing through the middle gauze layer G3. Alternatively, the top gauze layer G1 and the bottom gauze layer G2 may be joined together indirectly via the middle gauze layer G3.

Further alternatively, connection parts may be formed by warps as illustrated or connection parts may be formed by wefts.

The top gauze layer G1 is constituted of warps (lengthwise yarns on a loom) 1, 2 and wefts (crosswise yarns on a loom) A, B. The wefts A, B are supplied to the warps 1, 2 so as to cross one another to thereby form a plain woven pattern.

A twisted yarn (first twisted yarn) having a 3.3 or greater twisting coefficient is employed as the warps 1, 2. A twisted yarn (second twisted yarn) having a 3.0 or less twisting coefficient is employed as the wefts A, B.

Meanwhile, a twisted yarn having a 3.3 or greater twisting coefficient is a twisted yarn in general use. A twisted yarn having a 3.0 or less twisting coefficient is called a soft twist yarn. Further, a twisted yarn having a 1.0 or less twisting coefficient falls within a range of a non-twisted yarn.

When employing a twisted yarn having a 3.5 or greater twisting coefficient as a typical twisted yarn and a twisted yarn having a 2.5 or less twisting coefficient as a soft twist yarn, the below mentioned effect will become more remarkable.

The twisting coefficient is an index indicating the strength of twisting in consideration with a thickness of a yarn. Larger number shows stronger twisting. A value obtained by multiplying a square root of yarn count and a twisting coefficient will show the number of twisting per inch.

The bottom gauze layer G2 is constituted of warps 3, 4 and wefts C, D. The wefts C, D are supplied to the warps 3, 4 so as to cross one another to thereby form a plain woven pattern.

A twisted yarn (third twisted yarn) having a 3.3 or greater twisting coefficient is employed as the wefts C, D. A twisted yarn (fourth twisted yarn) having a 3.0 or less twisting coefficient is employed as the warps 3, 4.

More specifically, when the top gauze layer G1 and the bottom gauze layer G2 are superimposed together, the warps 1, 2 (first twisted yarn) and the wefts C, D (third twisted yarn) have an orthogonally crossing relationship.

Further, the first twisted yarn and the third twisted yarn may have the same twisting coefficient (typical twisted yarn) or may have a different twisting coefficient in so far as they fall under a range of a typical twisted yarn. The second twisted yarn and the fourth twisted yarn (soft twist yarn or non-twisted yarn) may have the same twisting coefficient or may have a different twisting coefficient in so far as they fall under a range of a soft twist yarn or a non-twisted yarn.

The middle gauze layer G3 is constituted of warps 5, 6 and wefts E, F. The wefts E, F are supplied to the warps 5, 6 so as to cross one another to thereby form a plain woven pattern.

A twisted yarn (fifth twisted yarn) having a 3.3 or greater twisting coefficient is employed as the warps 5, 6. A twisted yarn (sixth twisted yarn) having a 3.3 or greater twisting coefficient is employed as the wefts E, F. More specifically, the middle gauze layer G3 has the conventionally generally used gauze structure.

Also, the fifth twisted yarn and the sixth twisted yarn may have the same twisting coefficient (typical twisted yarn) or may have a different twisting coefficient in so far as they fall under a range of the typical twisted yarn. Further, the fifth twisted yarn and the sixth twisted yarn may have the twisting coefficient identical to the first twisted yarn and the third twisted yarn (typical twisted yarn) or may have a different twisting coefficient in so far as they fall under a range of the typical twisted yarn.

More specifically, the top gauze layer G1 is characterized in employing a soft twist yarn (or a non-twisted yarn) only as a weft, and the bottom gauze layer G2 is characterized in employing a soft twist yarn (or a non-twisted yarn) only as a warp. The middle gauze layer G3 is constituted of warps and wefts of typical twisted yarns.

Further, the first twisted yarn to the sixth twisted yarn may be hollow yarns. It is more preferred that they are ordinary yarns.

It is preferred that the first twisted yarn to the sixth twisted yarn are pure cotton yarns. It is possible to apply regenerated fibers such as plant-derived rayon.

Now, the weave construction densities of the top gauze layer G1 and the bottom gauze layer G2 will be described below.

When a yarn having a yarn count of 60 (yarn count of 55-64) (converted by a single yarn) is employed, the basic density is set to 47 warps per inch and 40 wefts per inch.

A lower limit of the basic density is set to 30 warps per inch and 30 wefts per inch. In a case of a density below the lower limit, a satisfactory good touch feeling cannot be expected because of too little number of soft twist yarns (or non-twisted yarns). Such weave construction is too coarse, i.e., gaps (which will be described below in detail) restricting the soft twist yarns (or non-twisted yarns) becomes wide. This makes the weave construction loose and lowers the frictional strength largely.

An upper limit of the basic density is set to 60 warps per inch and 60 wefts per inch. In a case of a density beyond the upper limit, a satisfactory good bounce feeling cannot be expected because spaces between the neighboring yarns become narrow and thus the puffiness of the soft twist yarns (or the non-twisted yarns) is restricted. Further, the weave construction becomes too dense and thus gaps for restricting the soft twist yarns (or non-twisted yarns) become narrow. As a result, bulkiness caused by a difference in shrinkage of yarns is hardly generated. For the reasons as set forth above, a satisfactory good touch feeling cannot be produced.

Practically, a preferable density is 40-50 warps per inch and 40-50 wefts per inch.

When a yarn having a yarn count of 50 (converted by a single yarn) is employed, a basic density is set to 43 warps per inch and 40 wefts per inch.

A lower limit of the basic density is set to 27 warps per inch and 27 wefts per inch. An upper limit of the basic density is set to 55 warps per inch and 55 wefts per inch.

Practically, a preferable density is 35-50 warps per inch and 35-50 wefts per inch.

When a yarn corresponding to a 40 count yarn (yarn count of 35-44) (converted by a single yarn) is employed, a basic density is set to 40 warps per inch and 40 wefts per inch.

A lower limit of the basic density is set to 25 warps per inch and 25 wefts per inch. An upper limit of the basic density is set to 50 warps per inch and 50 wefts per inch.

Practically, a preferable density is 30-45 warps per inch and 30-45 wefts per inch.

A weave construction density of the middle gauze layer G3 will be described below.

When a yarn having a yarn count of 60 (yarn count of 55-64) (converted by a single yarn) is employed, a basic density is set to 47 warps per inch and 40 wefts per inch.

A lower limit of the basic density is set to 30 warps per inch and 30 wefts per inch. In a case of a density below the lower limit, the weave construction loses cloth strength because the construction becomes too coarse.

An upper limit of the basic density is set to 60 warps per inch and 60 wefts per inch. In a case of a density beyond the upper limit, the cloth becomes stiff because of narrow gaps between the neighboring yarns. Meanwhile, even if the cloth of the middle gauze layer G3 becomes stiff, a touch feeling (softness) of the front surface is not directly adversely affected, but such stiffness of the middle gauze layer G3 will give an adverse effect indirectly to a feeling of one's own body.

Practically, a preferable density is 40-50 warps per inch and 40-50 wefts per inch.

When a yarn having a yarn count of 50 (yarn count of 45-54) (converted by a single yarn) is employed, a basic density is set to 43 warps per inch and 40 wefts per inch.

A lower limit of the basic density is set to 27 warps per inch and 27 wefts per inch. An upper limit of the basic density is set to 55 warps per inch and 55 wefts per inch.

Practically, a preferable density is 35-50 warps per inch and 35-50 wefts per inch.

When a yarn having a yarn count of 40 (yarn count of 35-44) (converted by a single yarn) is employed, a basic density is set to 40 warps per inch and 40 wefts per inch.

A lower limit of the basic density is set to 25 warps per inch and 25 wefts per inch. An upper limit of the basic density is set to 50 warps per inch and 50 wefts per inch.

Practically, a preferable density is 30-45 warps per inch and 30-45 wefts per inch.

Meanwhile, the first twisted yarn to the sixth twisted yarn may have the same yarn count or may have a different yarn count.

FIG. 1 and FIG. 2 shows examples in which first twisted yarn to sixth twisted yarn have the same yarn count. A soft twist yarn (non-twisted yarn) appears to puff up to be thicker in comparison with a twisted yarn of the same yarn count. For the reason as set forth above, the second twisted yarn and the fourth twisted yarn are illustrated thick.

~Study of Touch Feeling~

By comparing with the top gauze layer of the triple gauze fabrics according to the related inventions (comparative example 1), a touch feeling of a top gauze layer of the triple gauze fabric according to the present embodiment will be studied. The same will be done about the bottom gauze layer.

Figure 3:
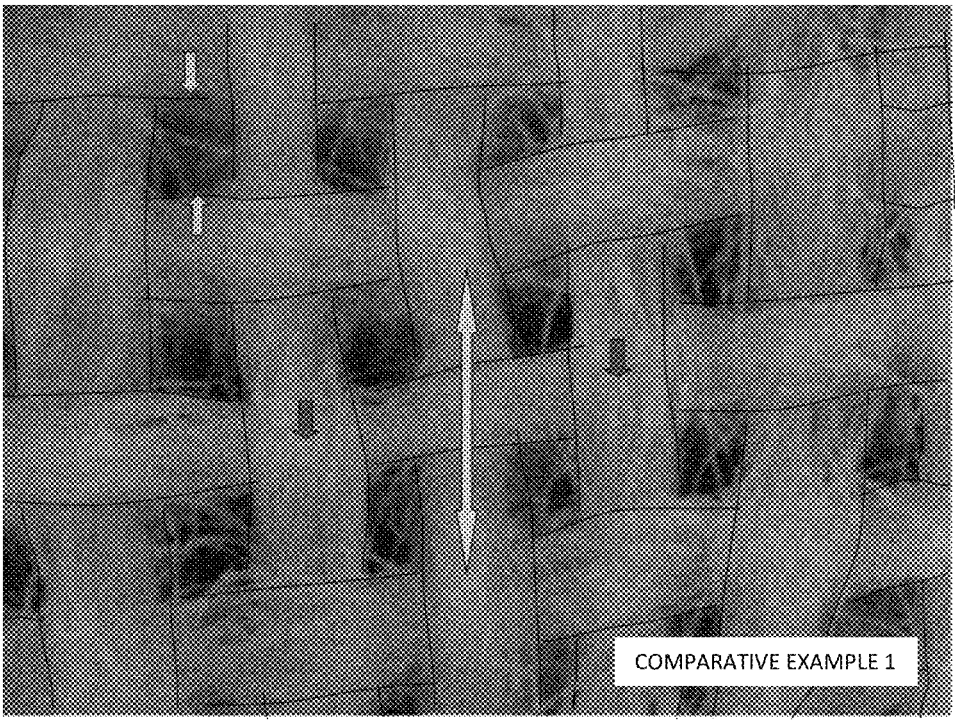
FIG. 3 shows a plain woven pattern according to comparative example 1.
Figure 4:
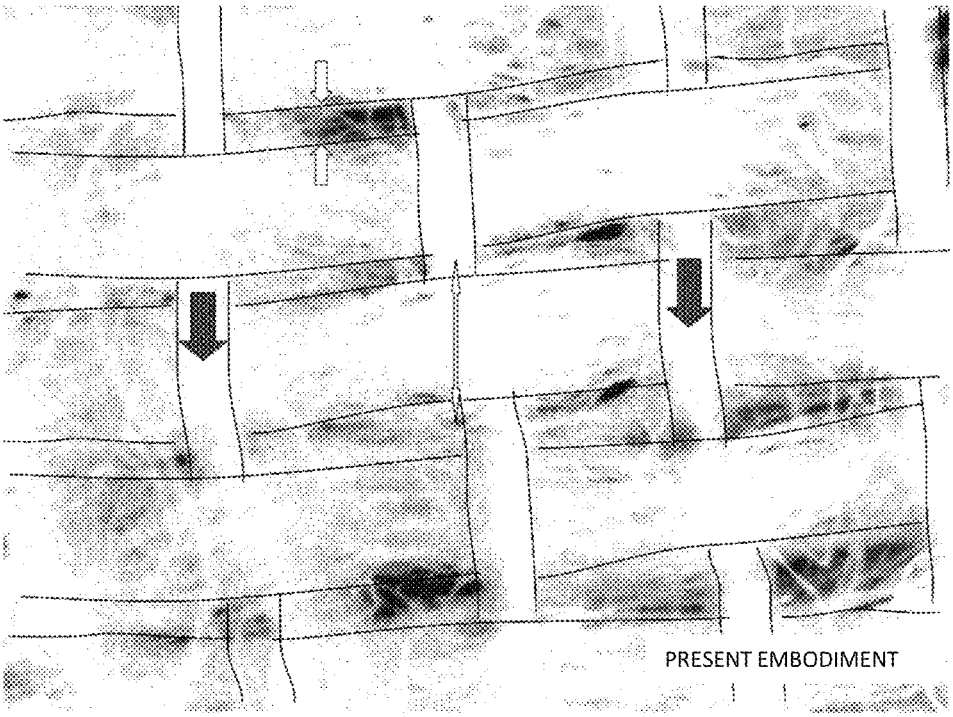
FIG. 4 shows a plain woven pattern according to the present embodiment.

FIG. 3 shows a plain woven pattern according to comparative example 1. FIG. 4 shows a plain woven pattern according to the present embodiment. In FIG. 4, an outer edge of a twisted yarn is additionally illustrated in an enlarged picture of the plain woven pattern. The principle of maintaining a good touch feeling will be described below by comparing the both. Arrows indicating densities are additionally illustrated in FIG. 3 and FIG. 4.

In comparative example 1, a soft twist yarn (or a non-twisted yarn) is employed as both of warps and wefts. In the present embodiment, a soft twist yarn (non-twisted yarn) is employed only as wefts to the contrary.

Incidentally, a gauze structure is formed by supplying wefts to warps. After the formation of the gauze structure, the gauze structure is subjected to impregnation in water via washing, dyeing, etc. Then, the gauze structure is dried for shrinkage. At the time, a shrinkage rate differs between the twisted yarn and the soft twist yarn (or the non-twisted yarn). In other words, the twisted yarn tends to shrink, whereas the soft twist yarn (or the non-twisted yarn) is hard to shrink.

That is, both the warps and wefts are hard to shrink in comparative example 1, whereas the warps tend to shrink but wefts are hard to shrink in the present embodiment. Shrinkage of the warps makes the wefts slightly denser than designed. High density of the soft twist yarn (or non-twisted yarn) maintains a good touch feeling.

Further, there is a difference in shrinkage between the top gauze layer and the middle gauze layer. Wefts (soft twist yarn or non-twisted yarn) of the top gauze layer cannot follow the shrinkage of the wefts (typical twisted yarn) of the middle gauze layer, so that wrinkles are generated due to the wefts. The warps (typical twisted yarn) of the top gauze layer, however, shrink to the extent equivalent to the warps (typical twisted yarn) of the middle gauze layer. Therefore, wrinkles are not generated by the warps.

Figure 5:
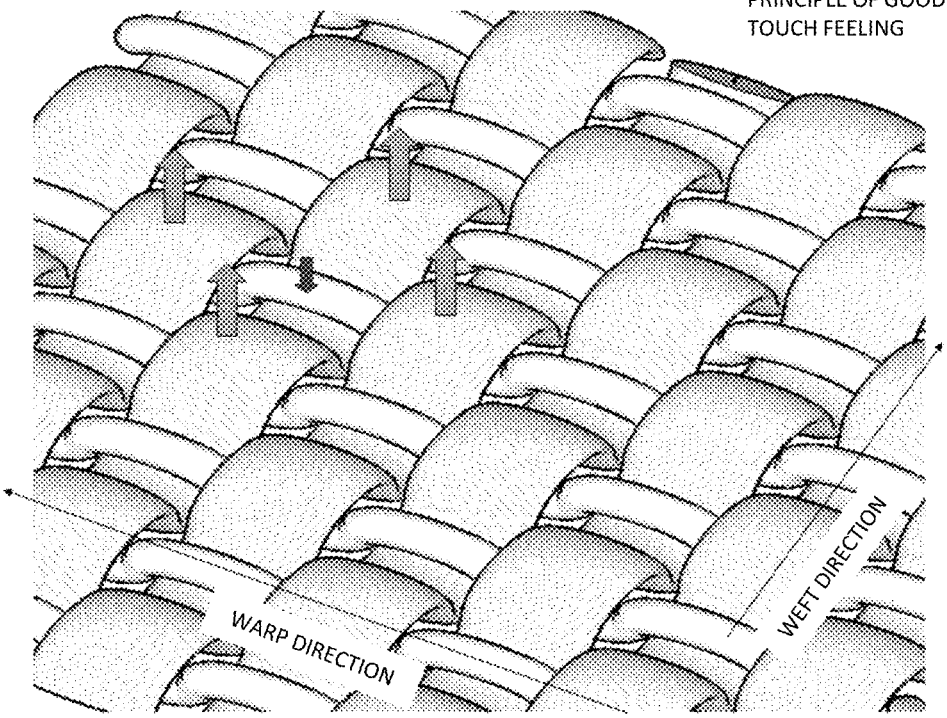
FIG. 5 supplementary illustrates the principle of maintaining a good touch feeling.

FIG. 5 supplementary illustrates the principle of maintaining a good touch feeling. Due to the difference in shrinkage between layers, the wefts (the soft twist yarn or the non-twisted yarn) of the top gauze layer rise. To the contrary, the warps (typical twisted yarn) of the top gauze layer which have no difference in shrinkage are buried (go under).

As described above, only the soft twist yarn (or non-twisted yarn) having a feel of soft touch exposes. The typical twisted yarn having a hard touch feeling does not expose and thus does not contact the skin. This enables maintaining of a good touch feeling (softness) equivalent to the fabric of comparative example 1.

Incidentally, the touch feeling is a highly subjective feeling and thus is difficult to judge objectively. An exposure percentage of the soft twist yarn (or the non-twisted yarn) is judged based on an image analysis of FIG. 3. It is found that the exposure percentage of the present embodiment corresponds to that of comparative example 1. As a result, it is confirmed that the present embodiment maintains the good touch feeling (softness) equivalent to comparative example 1.

~Study of Frictional Resistance~

By comparing with the top gauze layer of the triple gauze fabrics according to the related inventions (comparative example 1), the frictional resistance of the top gauze layer of the triple gauze fabric according to the present embodiment will be studied. Here, the same is done about the bottom gauze layer.

The principle of improving the frictional strength will be described below by comparing FIG. 3 with FIG. 4. In FIGS. 3 and 4, arrows indicating binding at crossing points and a movement of the soft twist yarn (or the non-twisted yarn) are supplementary illustrated.

In comparative example 1, a soft twist yarn (or a non-twisted yarn) is employed as both of the warps and the wefts. To the contrary, in the present embodiment, a soft twist yarn (or a non-twisted yarn) is employed only as the wefts.

As set forth above, the present embodiment is dense with wefts, i.e., the soft twist yarn (or the non-twisted yarn), in comparison with comparative example 1. In other words, gaps between the neighboring yarns become narrow to suppress a movement of width of the wefts in an orthogonal direction, thereby restricting the movement.

Figure 6:
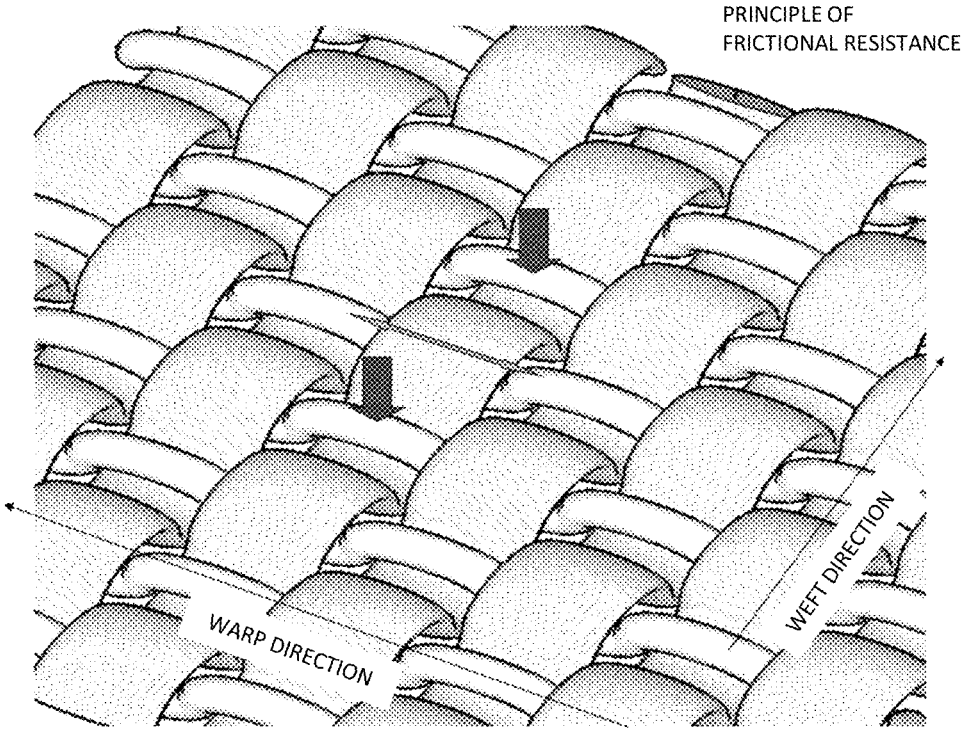
FIG. 6 supplementary illustrates the principle of improving frictional strength.

FIG. 6 supplementary illustrates the principle of improving the frictional strength. In comparative example 1, a soft twist yarn (or a non-twisted yarn) is employed also as the wefts, and thus bindings at cross points are weak. To the contrary, in the present embodiment, as set forth above, the warps (typical twisted yarn) go under the wefts (the soft twist yarn or the non-twisted yarn) exposing near the warps (typical twisted yarn) and bind the wefts (the soft twist yarn or the non-twisted yarn) at cross points.

In the present embodiment, owing to the effect of binding the wefts (the soft twist yarn or the non-twisted yarn), the movement is suppressed and thereby the frictional strength is improved in comparison with comparative example 1.

Figure 7:
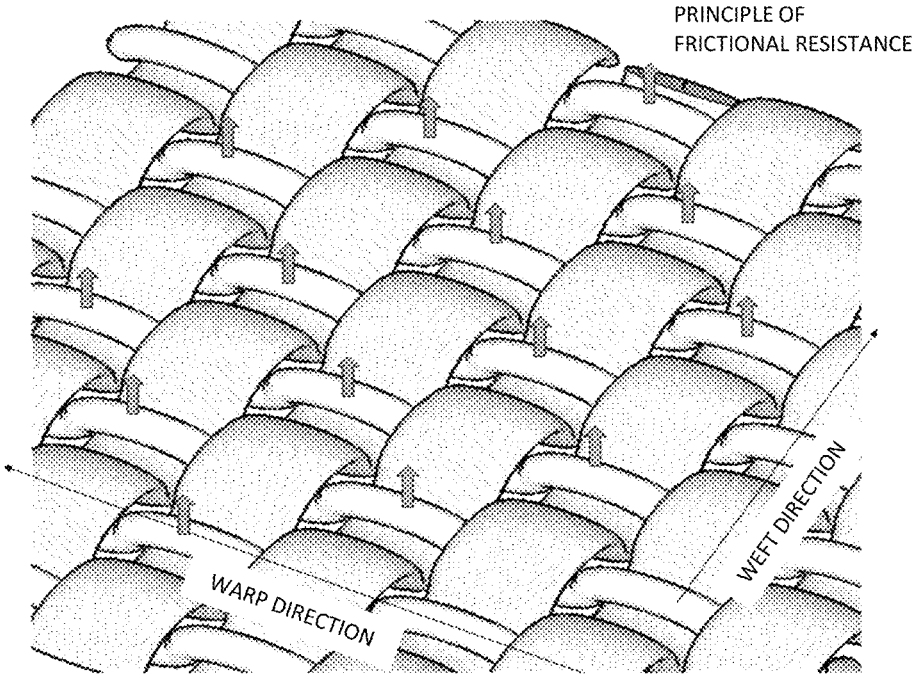
FIG. 7 illustrates the principle of improving frictional strength by another way.

FIG. 7 illustrates the principle of improving the frictional strength by another way. In the present embodiment, as set forth above, the warps (typical twisted yarn) go under the wefts (the soft twist yarn or the non-twisted yarn) exposing near the warps at a normal time (at a time without receiving a force), and thus do not expose. Therefore, it has been considered that the warps (typical twisted yarn) do not contribute to the improvement of the frictional strength.

A problem of frictional resistance appears in a case where clothes contact the skin, a chair, a desk, etc. to receive a force therefrom. The force causes the warps (typical twisted yarn) going under to expose to a side of the front surface, thereby generating the frictional resistance.

As set forth above, the multiplier effect of the binding and the external pressure contributes to remarkable improvement of the frictional strength in the present embodiment in comparison with comparative example 1.

For the reference sake, comparison was also made between the present embodiment and comparative example 1 and the conventionally used triple gauze fabric (comparative example 2). As a result, it was confirmed that the present embodiment simply had not an average frictional resistance between comparative example 1 and comparative example 2 but the frictional strength equivalent to comparative example 2.

~Effect~

As set forth above, the present embodiment is excellent in frictional strength in comparison with comparative example 1 while maintaining a good touch feeling equivalent to comparative example 1.

Because, in the present embodiment, a soft twist yarn (or a non-twisted yarn) is employed as only one of the warps or the wefts in the top gauze layer and the bottom gauze layer, a production cost lower than comparative example 1 can be achieved.

In the present embodiment, when the top gauze layer G1 and the bottom gauze layer G2 are superimposed together, the warps 1, 2 (first twisted yarn) and the wefts C, D (third twisted yarn) have an orthogonally crossing relationship. The positional relationship in which typical twisted yarns cross at right angles is shown in the conventionally used gauze structure. In other words, a combination of the warps 1, 2 (first twisted yarn) and the wefts C, D (third twisted yarn) secures the cloth strength together with the middle gauze layer G3. Consequently, the present embodiment is excellent in the cloth strength in comparison with comparative example 1.

~Modification~

The present embodiment is characterized in that the top gauze layer G1 employs a soft twist yarn (or a non-twisted yarn) only as wefts, and the bottom gauze layer G2 employs a soft twist yarn (or a non-twisted yarn) only as warps.

Alternatively, the top gauze layer G1 may employ a soft twist yarn (or a non-twisted yarn) only as warps, and the bottom gauze layer G2 may employ a soft twist yarn (or a non-twisted yarn) only as wefts.

In the present embodiment, it is supposed that the first twisted yarn to the sixth twisted yarn have the same yarn count. In the top gauze layer G1, however, the second twisted yarn (a soft twist yarn or a non-twisted yarn) may be thicker than the first twisted yarn (typical twisted yarn). Further, in the bottom gauze layer G2, the fourth twisted yarn (a soft twist yarn or a non-twisted yarn) may be thicker than the third twisted yarn (typical twisted yarn).

Thicker soft twist yarn (or the non-twisted yarn) produces more remarkable good touch feeling (softness).

In the present embodiment, the top gauze layer and the bottom gauze layer are formed into a plain woven pattern. Alternatively, the top gauze layer and the bottom gauze layer may be formed into a twill weave pattern or a satin weave pattern.

Figure 8:
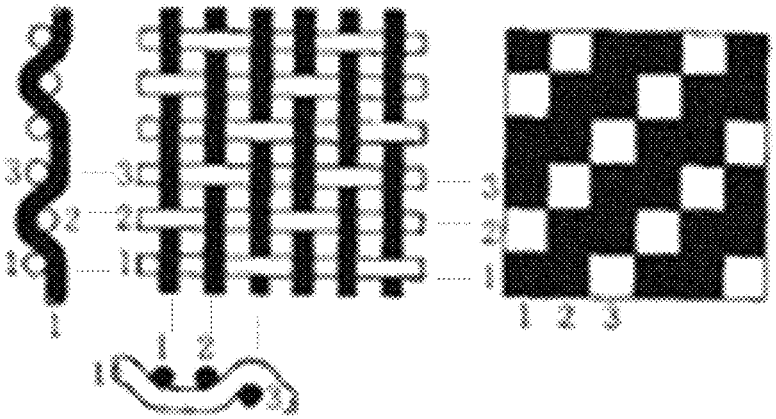
FIG. 8 schematically shows a twill weave pattern.

FIG. 8 schematically illustrates a twill weave pattern. A structure of the twill weave pattern is illustrated on the left hand, and a construction of the twill weave pattern is illustrated on the right hand.

The twill weave includes 2/1 twill weave (as shown) and 3/1 twill weave. The 2/1 twill weave has such a construction that a warp goes under one weft after passing through two wefts, and this is repeated. The 3/1 twill weave has such a construction that a warp goes under one weft after passing through 3 wefts, and this is repeated. The crossing points rise regularly and are aligned obliquely.

For example, in the top gauze layer G1, the second twisted yarn is arranged such that it goes under one first twisted yarn after passing over two first twisted yarns, and this is repeated. In the top gauze layer G1, a side on which the second twisted yarn exposes more is arranged as a front surface.

Similarly, the fourth twisted yarn is arranged such that it goes over one third twisted yarn after going under two third twisted yarns, and this is repeated. In the bottom gauze layer G2, a side on which the fourth twisted yarn exposes more is arranged as a front surface.

Increase of exposure frequency of the soft twist yarn (or the non-twisted yarn) produces more satisfactory good touch feeling (softness).

Figure 9:
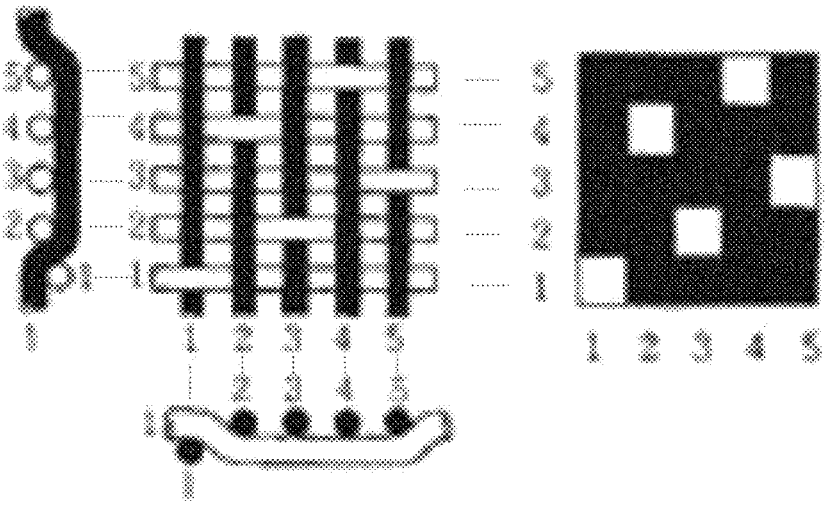
FIG. 9 schematically shows a satin weave pattern.

FIG. 9 schematically illustrates a satin weave pattern. A structure of the satin weave pattern is illustrated on the left hand, and a construction of the satin weave pattern is illustrated on the right hand.

The satin weave pattern is constituted of repetition of a combination of 5 or more warps and 5 or more wefts. Either one of the warps and the wefts rise more.

For example, in the top gauze layer G1, the second twisted yarn is arranged to go under one first twisted yarn after passing over four first twisted yarns, and this is repeated. In the top gauze layer G1, a side on which the second twisted yarn exposes more is arranged as a front surface.

Similarly, the fourth twisted yarn is arranged to pass over one third twisted yarn after going under four third twisted yarns, and this is repeated. In the bottom gauze layer G2, a side on which the fourth twisted yarn exposes more is arranged as a front surface.

Increase of exposure frequency of the soft twist yarn (or the non-twisted yarn) produces more satisfactory good touch feeling (softness).

Second Embodiment

The multiple gauze fabric according to the first embodiment was exemplified by a triple gauze fabric but may be a double gauze fabric.

Figure 10:
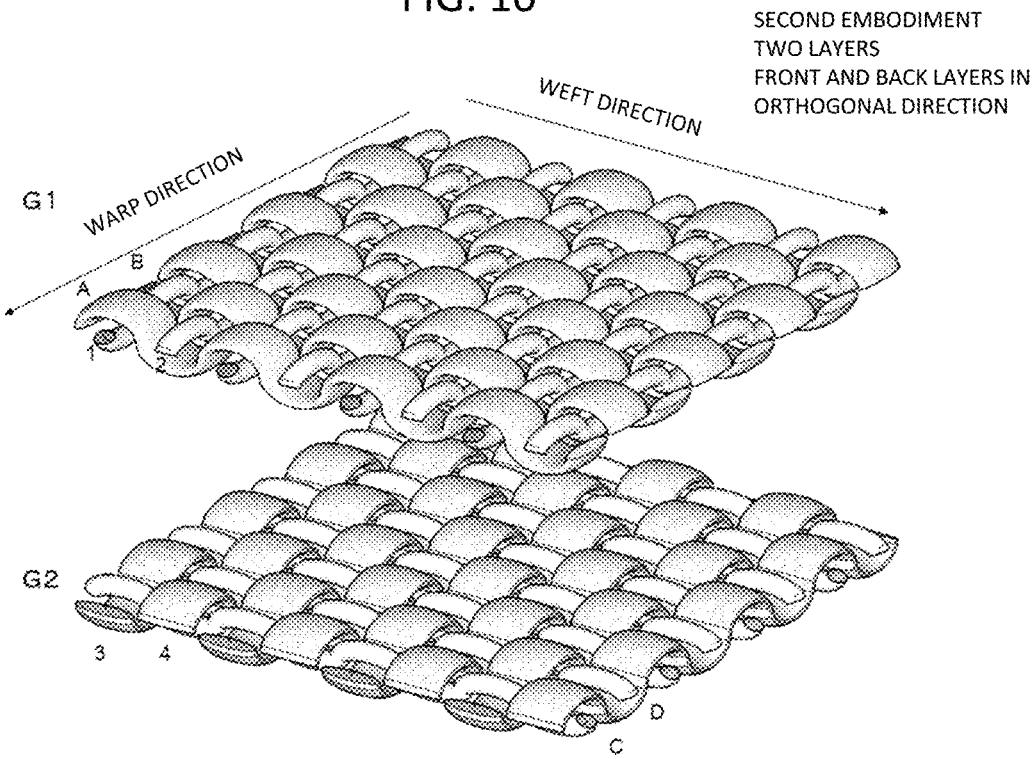
FIG. 10 is a conceptual scheme of a multiple gauze fabric according to a second embodiment.
Figure 11:
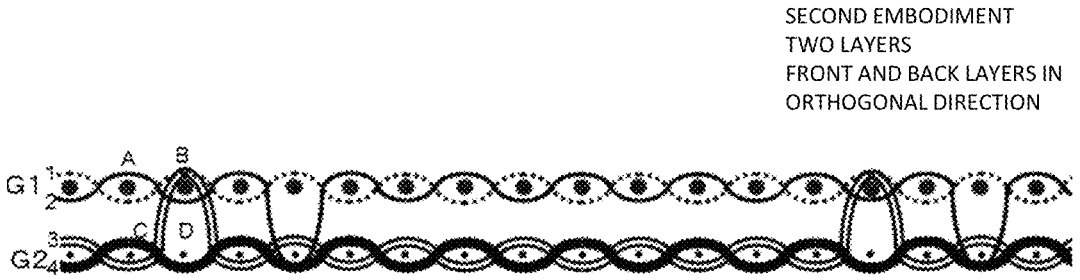
FIG. 11 is a sectional view of a multiple gauze fabric according to the second embodiment.

FIG. 10 is a conceptual scheme illustrating a multiple gauze fabric according to a second embodiment. For the sake of simplification, joining structure is omitted from the drawing. FIG. 11 is a sectional view of the multiple gauze fabric according to the second embodiment.

In the first embodiment, when the top gauze layer G1 and the bottom gauze layer G2 are superimposed together, the warps 1, 2 (first twisted yarn) and the wefts C, D (third twisted yarn) have an orthogonally crossing relationship. The positional relationship in which typical twisted yarns cross at right angles is shown in the conventionally used gauze structure. In other words, cloth strength equivalent to the middle gauze layer G3 can be expected.

Therefore, in a case where the cloth strength to the extent equivalent to the first embodiment is not required, the middle gauze layer G3 can be omitted. In other words, the multiple gauze fabric can be a double gauze fabric.

Third Embodiment

~Summary~

In the first embodiment, when the top gauze layer G1 and the bottom gauze layer G2 are superimposed together, the warps 1, 2 (first twisted yarn) and the wefts C, D (third twisted yarn) have an orthogonally crossing relationship. Alternatively, the warps and the wefts may be oriented to the same direction.

In the first embodiment, the cloth strength is secured by a combination of the warps 1, 2 (first twisted yarn) and the wefts C, D (third twisted yarn) together with the middle gauze layer G3. In a case where the cloth strength to the extent equivalent to the first embodiment is not required, the cloth strength may be secured only by the middle gauze layer G3.

~Construction~

Figure 12:
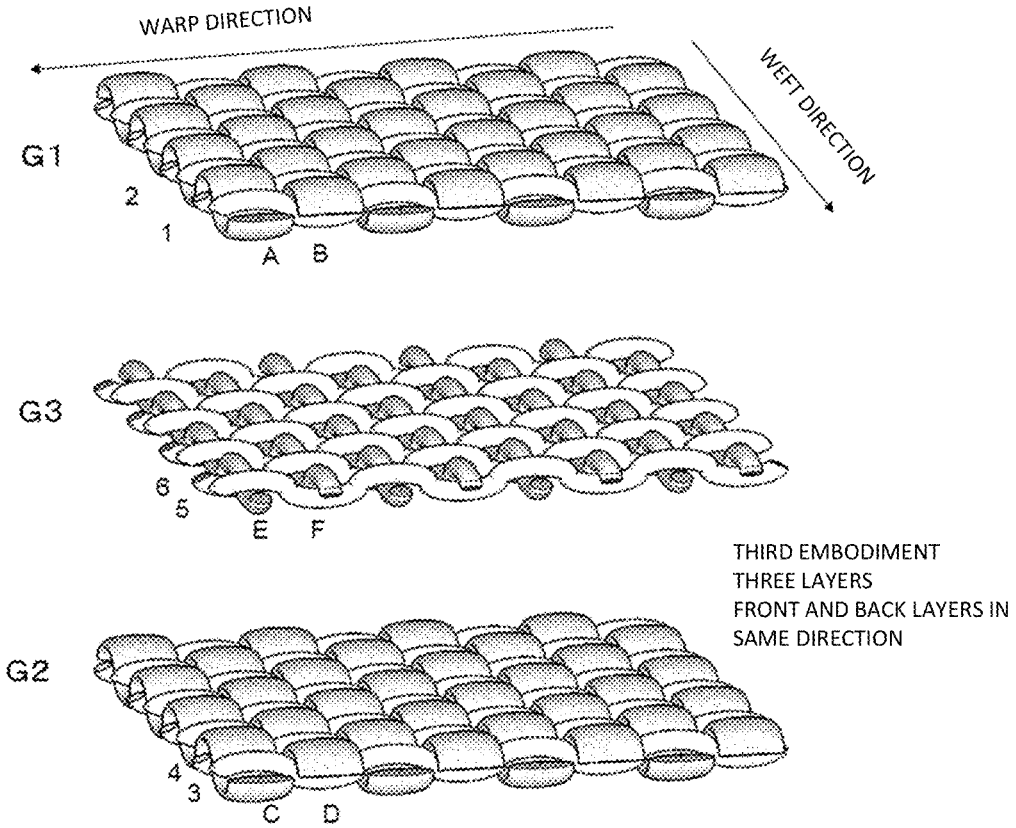
FIG. 12 is a conceptual scheme of a multiple gauze fabric according to a third embodiment.
Figure 13:
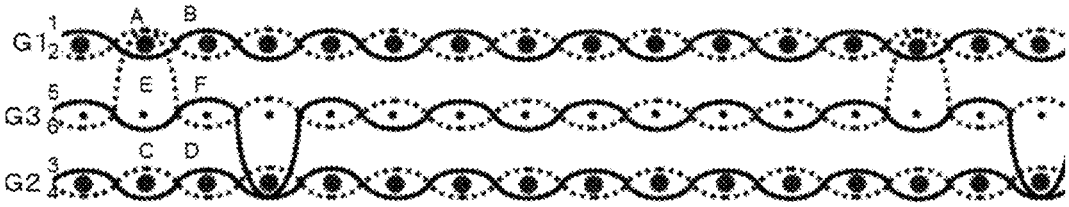
FIG. 13 is a sectional view of the multiple gauze fabric according to the third embodiment.
Figure 14:
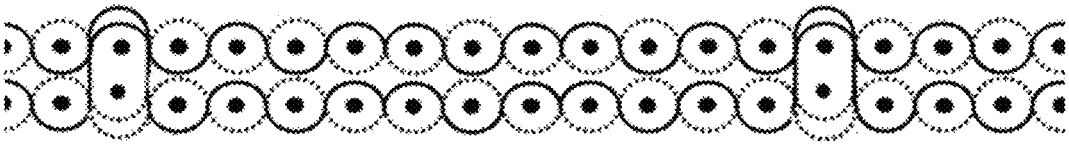
FIG. 14 CONVENTIONAL ART
FIG. 14 is a sectional view of a typical double woven gauze fabric.

FIG. 12 is a conceptual scheme of a multiple gauze fabric according to a third embodiment. For the sake of simplification, the joining structure is omitted from the drawing. FIG. 13 is a sectional view of the multiple gauze fabric according to the third embodiment.

The gauze fabric includes a top gauze layer G1, a bottom gauze layer G2, and a middle gauze layer G3.

The top gauze layer G1 is constituted of warps (lengthwise yarns on a loom) 1, 2 and wefts (crosswise yarns on a loom) A, B. A plain woven pattern in which the wefts A, B are supplied to the warps 1, 2 so as to cross one another is formed.

A twisted yarn (first twisted yarn) having a 3.3 or greater twisting coefficient is employed as the warps 1, 2. A twisted yarn (second twisted yarn) having a 3.0 or less twisting coefficient is employed as the wefts A, B.

The bottom gauze layer G2 is constituted of warps 3, 4 and wefts C, D. A plain woven pattern in which the wefts C, D are supplied to the warps 3, 4 so as to cross one another is formed.

A twisted yarn (third twisted yarn) having a 3.3 or greater twisting coefficient is employed as the warps 3, 4. A twisted yarn (fourth twisted yarn) having a 3.0 or less twisting coefficient is employed as the wefts C, D.

In other words, when the top gauze layer G1 and the bottom gauze layer G2 are superimposed together, the warps 1, 2 (first twisted yarn) and the warps 3, 4 (third twisted yarn) have a relationship of being oriented in the same direction.

The middle gauze layer G3 is constituted of warps 5, 6 and wefts E, F. A plain woven pattern in which the wefts E, F are supplied to the warps 5, 6 so as to cross one another is formed.

A twisted yarn (fifth twisted yarn) having a 3.3 or greater twisting coefficient is employed as the warps 5, 6. A twisted yarn (sixth twisted yarn) having a 3.3 or greater twisting coefficient is employed as the wefts E, F. More specifically, the middle gauze layer G3 has the conventionally used gauze structure.

~Modification~

The present embodiment is characterized in that the top gauze layer G1 employs a soft twist yarn (or a non-twisted yarn) only as wefts, and the bottom gauze layer G2 employs a soft twist yarn (or a non-twisted yarn) only as wefts.

To the contrary, the top gauze layer G1 may employ a soft twist yarn (or a non-twisted yarn) only as warps, and the bottom gauze layer G2 may employ a soft twist yarn (or a non-twisted yarn) only as warps.

The multiple gauze fabric according to the present embodiment was exemplified by a triple gauze but may be a double gauze. A double gauze may be employed for a part where the cloth strength is not required.

Application Example of Multiple Gauze Fabric

The multiple gauze fabric of the present invention has excellent frictional strength and cloth strength compared with comparative example 1 while maintaining properties of the multiple gauze fabric according to comparative example 1, i.e., breathability, lightness, bulkiness, a heat-retaining property, a feel of soft touch, and a transparency preventing property. Further, it saves production cost.

Consequently, the multiple gauze fabric of the present invention is suitable for, in addition to gauze towels and handkerchieves, cloth for clothing (gowns, pajamas, shirts, pants, mufflers, articles for infants, etc.) and cloth for beddings (sheets, blankets, pillow cases, etc.).

REFERENCE CHARACTER LIST

G1 top gauze layer
G2 bottom gauze layer
G3 middle gauze layer
1, 2 warp of top gauze layer
3, 4 warp of bottom gauze layer
5, 6 warp of middle gauze layer
A, B weft of top gauze layer
C, D weft of bottom gauze layer
E, F weft of middle gauze layer

The invention claimed is:

1. A multiple gauze fabric constituted of a plurality of gauze structures comprising a first gauze structure corresponding to a front surface, a second gauze structure corresponding to a back surface, and a third gauze structure corresponding to a middle layer:

wherein the first gauze structure and the second gauze structure are joined together directly and/or indirectly;

wherein the first gauze structure is formed by employing a first twisted yarn having a 3.3 or greater twisting coefficient as a warp or a weft, and a second twisted yarn having a 3.0 or less twisting coefficient as a weft or a warp;

wherein the second gauze structure is formed by employing a third twisted yarn having a 3.3 or greater twisting coefficient as a weft or a warp, and a fourth twisted yarn having a 3.0 or less twisting coefficient as a warp or a weft; and wherein the third gauze structure is formed by employing a fifth twisted yarn having a 3.3 or greater twisting coefficient as a warp, and a sixth twisted yarn having a 3.3 or greater twisting coefficient as a weft.

2. A double gauze fabric constituted of a first gauze structure corresponding to a front surface and a second gauze structure corresponding to a back surface:

wherein the first gauze structure and the second gauze structure are joined together;

wherein the first gauze structure is formed by employing a first twisted yarn having a 3.3 or greater twisting coefficient as a warp or a weft, and a second twisted yarn having a 3.0 or less twisting coefficient as a weft or a warp; and wherein the second gauze structure is formed by employing a third twisted yarn having a 3.3 or greater twisting coefficient as a weft or a warp, and a fourth twisted yarn having a 3.0 or less twisting coefficient as a warp or a weft.

3. A multiple gauze fabric constituted of a plurality of gauze structures comprising a first gauze structure corresponding to a front surface, a second gauze structure corresponding to a back surface, and a third gauze structure corresponding to a middle layer:

wherein the first gauze structure and the second gauze structure are joined together directly and/or indirectly;

wherein the first gauze structure is formed by employing a first twisted yarn having a 3.3 or greater twisting coefficient as a warp or a weft, and a second twisted yarn having a 3.0 or less twisting coefficient as a weft or a warp;

wherein the second gauze structure is formed by employing a third twisted yarn having a 3.3 or greater twisting coefficient as a warp or a weft, and a fourth twisted yarn having a 3.0 or less twisting coefficient as a weft or a warp; and wherein the third gauze structure is formed by employing a fifth twisted yarn having a 3.3 or greater twisting coefficient as a warp, and a sixth twisted yarn having a 3.3 or greater twisting coefficient as a weft.

4. The multiple gauze fabric according to claim 1:

wherein, in the first gauze structure, the first twisted yarn having a yarn count of 20-60 is set to a density from 25 yarns to 60 yarns per inch, and the second twisted yarn having a yarn count of 20-60 is set to a density from 25 yarns to 60 yarns per inch; and wherein, in the second gauze structure, the third twisted yarn having a yarn count of 20-60 is set to a density from 25 yarns to 60 yarns per inch, and the fourth twisted yarn having a yarn count of 20-60 is set to a density from 25 yarns to 60 yarns per inch.

5. The multiple gauze fabric according to claim 1:

wherein, in the first gauze structure, the second twisted yarn is thicker than the first twisted yarn; and wherein, in the second gauze structure, the fourth twisted yarn is thicker than the third twisted yarn.

6. The multiple gauze fabric according to claim 1:

wherein, in the first gauze structure, the second twisted yarn is arranged to pass through one side of N, wherein N is an integer more than 2, number of first twisted yarns and thereafter to pass through the other side of one of first twisted yarns, and a side on which the second twisted yarn exposes more is arranged as a front surface; and wherein, in the second gauze structure, the fourth twisted yarn is arranged to pass through one side of N, wherein N is an integer more than 2, number of third twisted yarns and thereafter to pass through the other side of one of third twisted yarns, and a side on which the fourth twisted yarn exposes more is arranged as a back surface.

7. Clothes produced by sewing the multiple gauze fabric according to claim 1.

8. Bedding produced by sewing the multiple gauze fabric according to claim 1.

9. The double gauze fabric according to claim 2:

wherein, in the first gauze structure, the first twisted yarn having a yarn count of 20-60 is set to a density from 25 yarns to 60 yarns per inch, and the second twisted yarn having a yarn count of 20-60 is set to a density from 25 yarns to 60 yarns per inch; and wherein, in the second gauze structure, the third twisted yarn having a yarn count of 20-60 is set to a density from 25 yarns to 60 yarns per inch, and the fourth twisted yarn having a yarn count of 20-60 is set to a density from 25 yarns to 60 yarns per inch.

10. The double gauze fabric according to claim 2:

wherein, in the first gauze structure, the second twisted yarn is thicker than the first twisted yarn; and wherein, in the second gauze structure, the fourth twisted yarn is thicker than the third twisted yarn.

11. The double gauze fabric according to claim 2:

wherein, in the first gauze structure, the second twisted yarn is arranged to pass through one side of N, wherein N is an integer more than 2, number of first twisted yarns and thereafter to pass through the other side of one of first twisted yarns, and a side on which the second twisted yarn exposes more is arranged as a front surface; and wherein, in the second gauze structure, the fourth twisted yarn is arranged to pass through one side of N, wherein N is an integer more than 2, number of third twisted yarns and thereafter to pass through the other side of one of third twisted yarns, and a side on which the fourth twisted yarn exposes more is arranged as a back surface.

12. Clothes produced by sewing the double gauze fabric according to claim 2.

13. Bedding produced by sewing the double gauze fabric according to claim 2.

14. The multiple gauze fabric according to claim 3:

wherein, in the first gauze structure, the first twisted yarn having a yarn count of 20-60 is set to a density from 25 yarns to 60 yarns per inch, and the second twisted yarn having a yarn count of 20-60 is set to a density from 25 yarns to 60 yarns per inch; and wherein, in the second gauze structure, the third twisted yarn having a yarn count of 20-60 is set to a density from 25 yarns to 60 yarns per inch, and the fourth twisted yarn having a yarn count of 20-60 is set to a density from 25 yarns to 60 yarns per inch.

15. The multiple gauze fabric according to claim 3:

wherein, in the first gauze structure, the second twisted yarn is thicker than the first twisted yarn; and wherein, in the second gauze structure, the fourth twisted yarn is thicker than the third twisted yarn.

16. The multiple gauze fabric according to claim 3:

wherein, in the first gauze structure, the second twisted yarn is arranged to pass through one side of N, wherein N is an integer more than 2, number of first twisted yarns and thereafter to pass through the other side of one of first twisted yarns, and a side on which the second twisted yarn exposes more is arranged as a front surface; and wherein, in the second gauze structure, the fourth twisted yarn is arranged to pass through one side of N, wherein N is an integer more than 2, number of third twisted yarns and thereafter to pass through the other side of one of third twisted yarns, and a side on which the fourth twisted yarn exposes more is arranged as a back surface.

17. Clothes produced by sewing the multiple gauze fabric according to claim 3.

18. Bedding produced by sewing the multiple gauze fabric according to claim 3.

* * * * *